United States Patent [19]

Murakami et al.

[11] 4,205,517

[45] Jun. 3, 1980

[54] ALARM ELECTRONIC TIMEPIECE

[75] Inventors: Fumikazu Murakami; Takuro Fukuichi, both of Tokyo, Japan

[73] Assignee: Kabushiki Kaisha Daini Seikosha, Japan

[21] Appl. No.: 907,575

[22] Filed: May 19, 1978

[30] Foreign Application Priority Data

May 23, 1977 [JP] Japan ..... 52-60108

[51] Int. Cl.[2] ..... G04B 13/00; G04B 13/12

[52] U.S. Cl. ..... 368/245; 368/72

[58] Field of Search ..... 58/12–14, 58/16, 19 R, 38 R, 21.12, 39.5, 57.5, 152 B, 130 R, 130 E; 340/384 R, 384 E; 328/58; 84/1.01, 1.03, 1.24, 1.27, 484

[56] References Cited

U.S. PATENT DOCUMENTS

| | | | |
|---|---|---|---|
| 3,861,263 | 1/1975 | Okudaira | 84/1.11 |
| 4,014,167 | 3/1977 | Hasegawa et al. | 58/130 E |
| 4,055,843 | 10/1977 | Whitaker | 340/384 E |
| 4,073,133 | 2/1978 | Earls et al. | 58/13 |
| 4,090,349 | 5/1978 | Takase | 58/12 |
| 4,098,071 | 7/1978 | Kawakami et al. | 58/39 |
| 4,104,862 | 8/1978 | Yamazaki et al. | 58/38 R |

*Primary Examiner*—Vit W. Miska

*Attorney, Agent, or Firm*—Robert E. Burns; Emmanuel J. Lobato; Bruce L. Adams

[57] ABSTRACT

An alarm electronic timepiece comprises a time circuit including a time standard signal oscillator for generating a time signal fed to a time display portion for displaying time. An alarm device is driven by an alarm driving circuit to produce an audible alarm sound. An alarm signal compound circuit develops a plurality of signals having different duty cycles and having a frequency in the audible frequency range, and serially arranges the plurality of signals in a predetermined pattern to form an alarm signal composed of the serially arranged signals of different duty cycles which is applied to the alarm driving circuit to produce an audible alarm sound having a predetermined sound pressure variation pattern.

12 Claims, 19 Drawing Figures

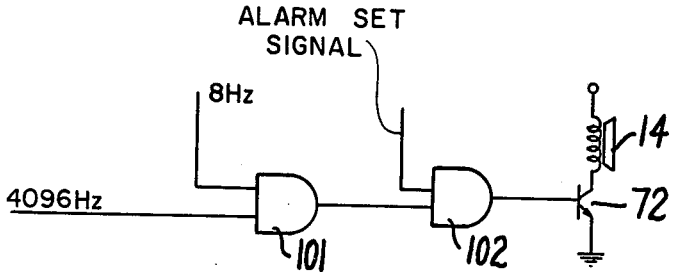
FIG. 1
PRIOR ART
FIG. 2A
PRIOR ART
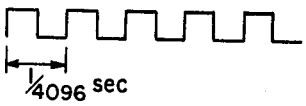
FIG. 2B
PRIOR ART
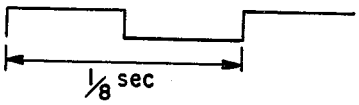
FIG. 2C
PRIOR ART
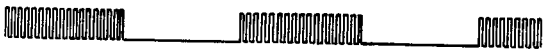
FIG. 3
PRIOR ART
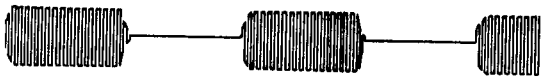
FIG. 7
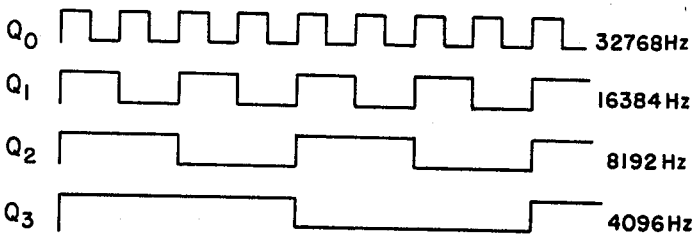

ALARM ELECTRONIC TIMEPIECE

BACKGROUND OF THE INVENTION

The present invention relates to improvements in the quality of the alarm sound generated by alarm electronic timepieces.

Generally, electronic timepieces display time by dividing outputs of a reference signal oscillator employing a quartz crystal or the like. In an alarm electronic timepiece, it is convenient to use the signal produced from the timepiece circuit portion as a signal source which drives a sound-producing device such as a speaker or the like.

FIG. 1 shows a circuit construction of a conventional timepiece circuit portion in which: an audible signal of 4096 Hz (see FIG. 2*a*) and an interrupting signal of 8 Hz (see FIG. 2*b*) are produced from the dividing stages of the timepiece circuit portion (not shown) and are fed to the input terminal of an AND circuit 101. The output from the AND circuit 101 and an alarm signal are fed to an AND circuit 102 and the output from the AND circuit 102 is connected to the base of an activating transistor 72. A speaker 14 is connected to the collector of the transistor 72. By the above mentioned construction, the audible signal of 4096 Hz is modulated by the intermittent signal of 8 Hz to produce the output signal shown in FIG. 2*c* from the AND circuit 101 and the output signal is fed to the base of the transistor 72 through the AND circuit when the alarm set signal is at high level and activates the speaker 14. The alarm set signal comprises a signal produced when the alarm sound is necessary, for instance at the predetermined alarm time or time service, though such is not shown in the drawing. The wave shape of the sound wave produced from the speaker 14 by the above mentioned construction and operation is, as shown in FIG. 3, the shape of 4096 Hz intermittent by 8 Hz. The advantage of the intermittent alarm sound is that it breaks the monotony of a continuous sound; however, this type conventional intermittent alarm sound is disadvantageous since the sound gives listeners an unpleasant feeling since the intermittence is carried on taking the shape of a square wave which produces an unnatural sound.

Accordingly, it is an object of the present invention to remove the above mentioned unpleasant feeling as much as possible by providing circuitry to obtain a more natural and pleasant sound by means of an easy logical operation within the timepiece.

Another object of the present invention is to improve the alarm sound produced by an alarm electronic timepiece by varying the duty cycle suitably taking advantage of the variation of the sound pressure caused by variation of the duty cycle of the audible signal. The signal referred to as the "audible signal" in this disclosure designates the signal within the audible frequency region which comprises the basic sound wave as opposed to the signal which determines the alarm time or the intermittent signal among the various signals fed to the alarm circuitry.

BRIEF DESCRIPTION OF THE DRAWINGS

FIG. 1 is a diagram showing an alarm signal compound circuit and a driving circuit of conventional type;

FIGS. 2 and 3 are explanatory waveforms for explaining the operation thereof;

FIG. 7 is a timing chart illustrating the operation of the dividing circuit shown in FIG. 5;

DETAILED DESCRIPTION OF INVENTION

One embodiment of the invention obtains a sound which sharply rises and then gradually attenuates to simulate a ring of bells and the other embodiment obtains an amplitude modulation of the sound to simulate the "tremolo effect." It is obvious that both embodiments improve the intermittent sound caused by the conventional square wave even though neither of the sounds are natural sounds.

Figure 4:
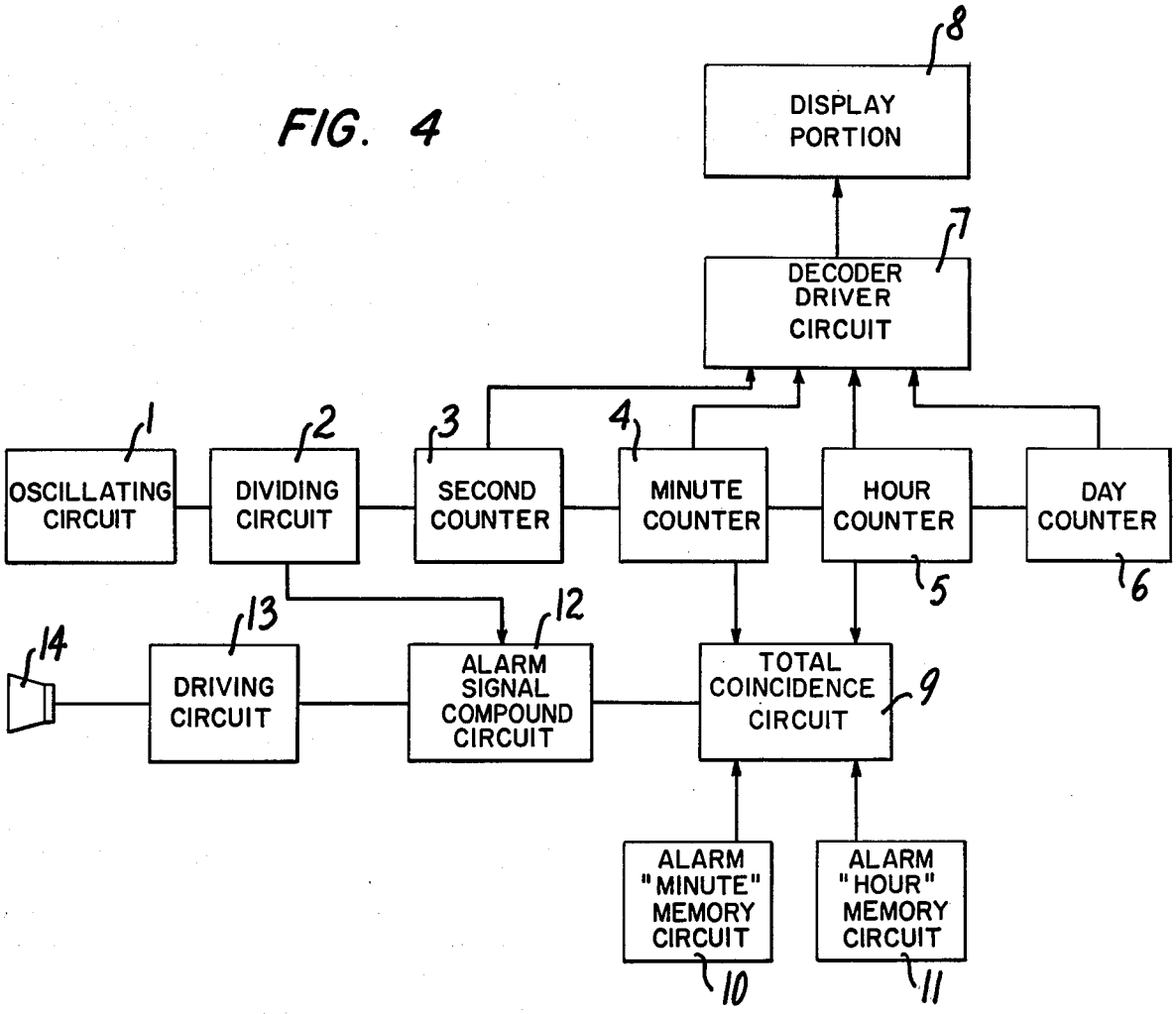
FIG. 4 is a block diagram of an alarm electronic timepiece according to the present invention.

Before describing the inventive embodiments in detail, a description will first be given of the construction and operation of an electronic timepiece provided with an alarm function in conjunction with FIG. 4.

The high frequency output of an oscillating circuit 1 is fed to a dividing circuit 2 and the divided lower frequency output therefrom is successively fed to a second counter 3, a minute counter 4, an hour counter 5 and a day counter 6. The contents of the second counter 3, the minute counter 4, the hour counter 5 and the day counter 6 are respectively fed to a decoder-driver circuit 7 whose output is fed to a display portion 8. The contents of the minute counter 4 and hour counter 5 are fed to a total coincidence circuit 9. Otherwise the contents of an alarm "minute" memory circuit 10 and an alarm "hour" memory circuit 11 are fed to the total coincidence circuit 9 and the output therefrom is fed to an alarm signal compound circuit 12. An intermediate output of the dividing circuit 2 is fed to the alarm signal compound circuit 12 and the output therefrom is fed to a driving circuit 13 connected to drive a speaker 14.

The operation of the alarm electronic timepiece having the above mentioned construction is as follows.

The oscillating circuit 1 generates a time reference signal such as a signal of 32,768 Hz of rectangular wave shape. The dividing circuit 2 is composed of multiple stages of cascade-connected flipflop circuits and divides the output signal of the oscillating circuit 1 into a signal of 1 Hz. The output signal from the dividing circuit 2 is fed to the second counter 3 composed of a 60 steps counter to count the seconds and the figure-up signal of the second counter 3 is fed to the minute counter 4 composed of a 60 steps counter to count the minutes.

The figure-up signal of the minute counter 4 is fed to the hour counter 5 composed of a 24 steps counter to count the hours and the figure-up signal of the hour counter 5 is fed to the day counter 6 to count the days. The bit signals of the above mentioned second counter 3, the minute counter 4, the hour counter 5 and the day counter 6 are fed to the decoder-driver circuit 7 to decode the bit signals and drive the display portion 8. The display portion 8 is composed of the display elements such as a liquid crystal, an illuminant diode or the like and displys the second, the minute, the hour and the day.

The total coincidence circuit 9 produces the alarm set signal of High level when the contents of the minute counter 4 and that of the alarm "minute" memory circuit 10 coincide and when the contents of the hour counter 5 and that of the alarm "hour" memory circuit 11 coincide, respectively, and accordingly detects the alarm time when such total coincidence exists.

The alarm signal compound circuit 12 is a main part of the present invention which will be detailedly illustrated later. The alarm signal compound circuit 12 compounds a plurality of signals having different duty cycles by the signal produced from the intermediate stages of the dividing circuit 2 and receives the audible signal. The output from the alarm signal compound circuit 12 is fed to the driving circuit 13 to drive the speaker 14. A brief outline of the construction and the operation of the alarm electronic timepiece has been illustrated so far and no illustration of the time correcting circuit, the alarm time setting circuit and the other circuitry which as a whole constitute the timepiece has been given since these are known in the art and not directly related to the present invention.

Figure 5:
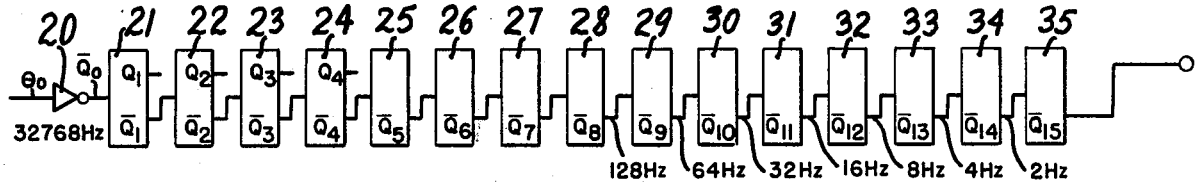
FIG. 5 is a circuit diagram of the dividing circuit of FIG. 4.

FIG. 5 shows one embodiment of the dividing circuit 2 which is connected to the alarm signal compound circuit 12. The output signal $Q_0$ of the oscillating circuit 1 is fed to an inverter 20 and the output $\overline{Q}_0$ therefrom is fed to a flip-flop 21 whose output $\overline{Q}_1$ is fed to the next flip-flop 22. In similar fashion, flip-flops 23 to 35 are connected in cascade as shown in the drawing and each flip-flop stage divides the signal in ½. Accordingly, as shown in the time charts in FIG. 7, the 32,768 Hz signal ($Q_0$) is successively divided into 16,384 Hz ($Q_1$), 8192 Hz ($Q_2$), 4096 Hz ($Q_3$), etc.

$Q_1$, $Q_2$ and $Q_3$ are respectively the output signals of the flip-flop 21, the flip-flop 22, and the flip-flop 23. The output signal $\overline{Q}_{15}$ of the flip-flop 35 is 1 Hz. Accordingly, a signal of $2^n$ frequency can easily be extracted from the dividing circuit composed of n stages.

Figure 6:
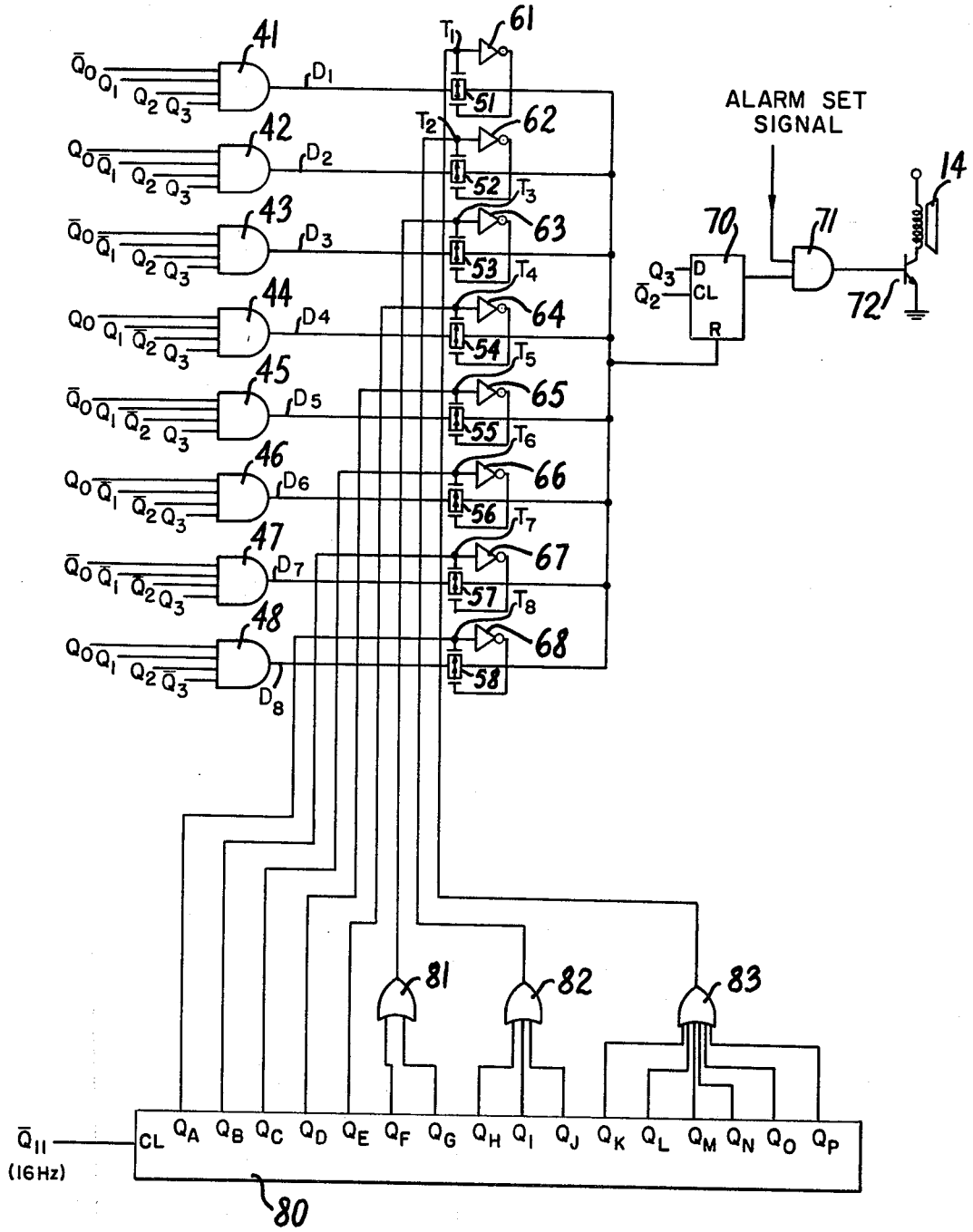
FIG. 6 is a circuit diagram of the alarm signal compound circuit and the driving circuit of FIG. 4.
Figure 10:
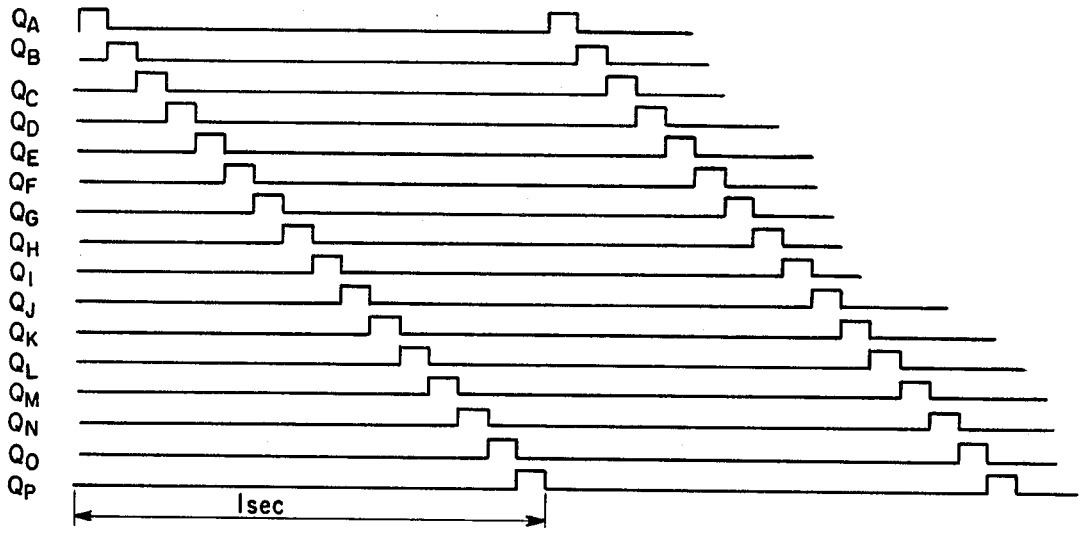

Referring now to the alarm signal compound circuit 12 and the driving circuit 13 in conjunction with an embodiment shown in FIG. 6, the signals $Q_0$, $\overline{Q}_0$, $Q_1$, $\overline{Q}_1$, $Q_2$, $\overline{Q}_2$, $Q_3$ and $\overline{Q}_3$ fed to the alarm signal compound circuit are produced from the dividing circuit shown in FIG. 5. Numerals 41 to 48 designate AND circuits of 4 inputs. $\overline{Q}_0$, $Q_1$, $Q_2$ and $Q_3$ signals are fed to the AND circuit 41; $Q_0$, $\overline{Q}_1$, $Q_2$ and $Q_3$ signals are fed to the AND circuit 42; $\overline{Q}_0$, $\overline{Q}_1$, $Q_2$ and $Q_3$ signals are fed to the AND circuit 43; $Q_0$, $Q_1$, $\overline{Q}_2$ and $Q_3$ signals are fed to the AND circuit 44; $\overline{Q}_0$, $Q_1$, $\overline{Q}_2$ and $Q_3$ signals are fed to the AND circuit 45; $Q_0$, $\overline{Q}_1$, $\overline{Q}_2$ and $Q_3$ signals are fed to the AND circuit 46; $\overline{Q}_0$, $\overline{Q}_1$, $\overline{Q}_2$ and $Q_3$ signals are fed to the AND circuit 47; and $Q_0$, $Q_1$ $Q_2$ and $\overline{Q}_3$ signals are fed to the AND circuit 48. The output signals $D_1$, $D_2$, $D_3$, $D_4$, $D_5$, $D_6$, $D_7$ and $D_8$ produced from the AND circuits 41 to 48 are altogether fed to a reset terminal R of a D-type flip-flop 70 respectively through transmission gates 51, 52, 53, 54, 55, 56, 57 and 58. Numeral 80 is a 16-step ring counter composed of a gate circuit which decodes the flip-flop and to a clock terminal CL there is fed the output $Q_{11}$ (16 Hz) of the flip-flop 32 shown in FIG. 5. The output signals $Q_A$, $Q_B$, $Q_C$, $Q_D$ and $Q_E$ of the ring counter 80 are respectively connected to junction points $T_8$, $T_7$, $T_6$, $T_5$ and $T_4$, and the output signals $Q_F$, $Q_G$ are fed to an OR circuit 81, the signals $Q_H$, $Q_I$ and $Q_J$ are fed to an OR circuit 82 and the signals $Q_K$, $Q_L$, $Q_M$, $Q_N$, $Q_O$ and $Q_P$ are fed to an OR circuit 83. The waveforms of the ring counter output signals $Q_A$ to $Q_P$ are shown in FIG. 10.

The outputs from the OR circuits 81, 82 and 83 are respectively connected to junction points $T_3$, $T_2$ and $T_1$. The $T_1$ junction point is connected to the N channel gate of the transmission gate 51 and also connected to the P channel gate of the transmission gate 51 through an inverter 61. Likewise, the $T_2$ point, $T_3$ point, $T_4$ point, $T_5$ point, $T_6$ point, $T_7$ point and $T_8$ point are respectively connected to the N channel gate of the transmission gates 52, 53, 54, 55, 56, 57 and 58 and these junction points are also connected to the respective P channel gates through inverters 62, 63, 64, 65, 66, 67 and 68. To the data terminal D of the D-type flip-flop 70 there is fed the signal $Q_3$ of 4096 Hz and to the clock terminal CL is fed the signal $\overline{Q}_2$ of 8192 Hz and the output of the flip-flop 70 is fed to one input of an AND circuit 71. To the other input of the AND circuit 71 is fed the alarm set signal which is the output signal of the total coincidence circuit 9 shown in FIG. 4.

Referring further to the driving circuit 13, the output from the AND circuit 71 is fed to the base of the transistor 72 and the emitter of the transistor 72 is grounded while the collector is connected to one end of the speaker 14. The other end of the speaker 14 is connected to a supply terminal (+1.5 volts) though not shown in the drawing.

Figure 8:
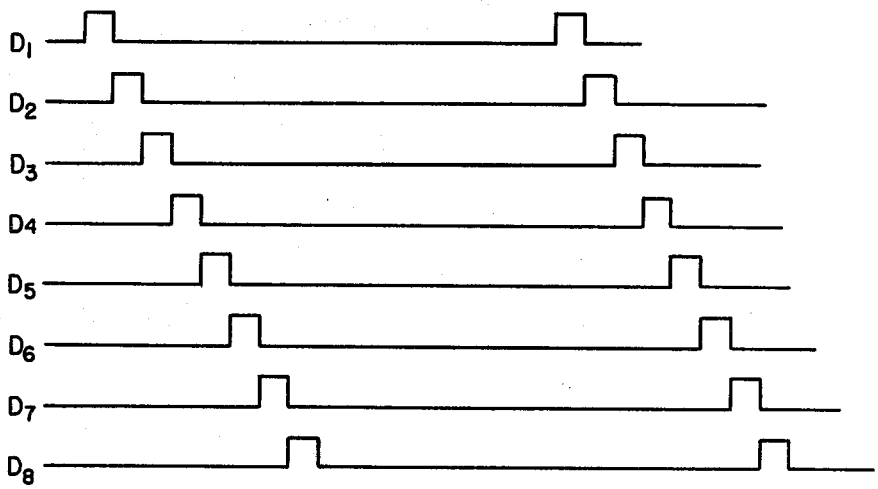
FIGS. 8, 9, 10 and 11 are timing charts illustrating the operation of the alarm signal compound circuit shown in FIG. 6.

A description will now be given of the operation of the alarm signal compound circuit 12 having the above mentioned construction. FIG. 8 is a timing chart of the respective output signals $D_1$, $D_2$, $D_3$, $D_4$, $D_5$, $D_6$, $D_7$ and $D_8$ of the AND circuits 41, 42, 43, 44, 45, 46, 47, and 48 which produce pulses successively delayed from one another by 1/65536 seconds. The operation of the AND circuits 41 to 48 decodes the flip-flop output signals $Q_0$, $Q_1$, $Q_2$ and $Q_3$ of the dividing circuit 2.

Figure 9:
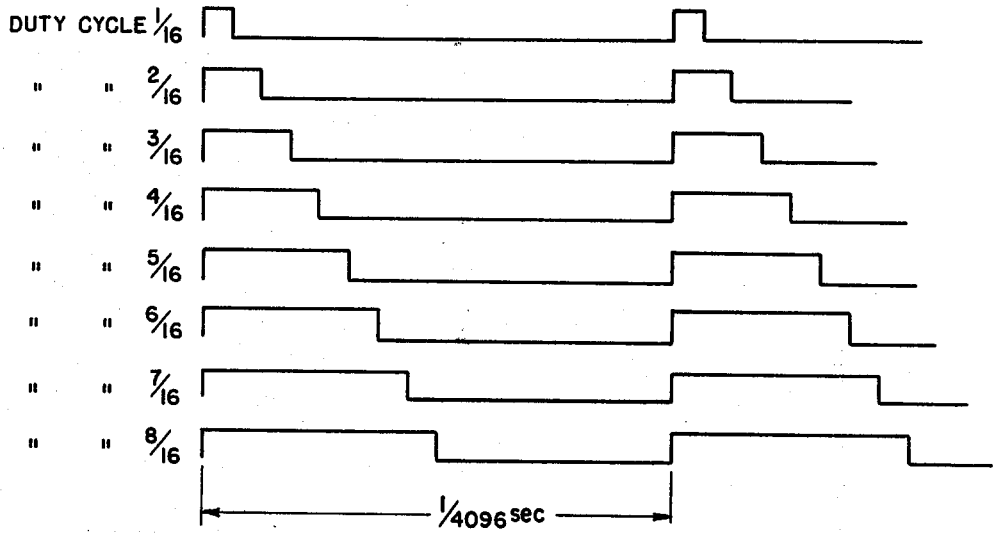

The output signals $D_1$ to $D_8$ are respectively fed to the reset terminal R of the D-type flip-flop 70 through the respective transmission gates. For instance, since the conducting transmission gate 51 resets the flip-flop 70 by the $D_1$ signal, the output wave shape of the flip-flop 70 produces the signal of 4096 Hz having a 1/16 duty cycle whose pulse ON period is 1/65536 seconds as shown in FIG. 9(A). Likewise, when the transmission gate 52 is conducting, the flip-flop 70 produces the signal of 4096 Hz having a 2/16 duty cycle as shown in FIG. 9(B) and when the transmission gates 53, 54, 55, 56, 57 and 58 are conducting, the signals $D_3$, $D_4$, $D_5$, $D_6$, $D_7$ and $D_8$ pass through the respective transmission gates and the output signals of the flip-flop 70 are as shown in FIG. 9(C-H). Namely, the output signal of the flip-flop 70 comprises a signal of 4096 Hz the duty cycles of which are 3/16, 4/16, 5/16, 6/16, 7/16 and 8/16. During this time, the transmission gates 51 to 58 are not conducting simultaneously but rather are controlled respectively by the output signals from the ring counter 80. To the clock terminal CL of the ring counter 80 there is fed a signal of 16 Hz ($\overline{Q}_{11}$) and the output signals $Q_A$ to $Q_P$ from the ring counter 80 successively lag one another by a phase difference of 1/16 second and the ring counter has a one second period as shown in the timing chart of FIG. 10.

The transmission gates are in the conducting state when the N channel gate is at a high level and the P channel gate is at a low level. For instance, the N channel gate of the transmission gate 58 is at a high level when $Q_A$ is at a high level since the input signal is connected with the $T_8$ junction point, and the P channel gate is at a low level via the inverter 68, whereby the transmission gate switches to its conducting state. Then the $D_8$ signal is transmitted to the flip-flop 70 which produces the signal of 8/16 duty cycle. The transmission gate 57 is conducting when $Q_B$ is at a high level and produces the signal of 7/16 duty cycle. Thus, when $Q_C$, $Q_D$, $Q_E$ are at a high level, the transmission gates 56, 55, 54 are respectively conducting and produce the signals of 6/16, 5/16, 4/16 duty cycles. The $O_F$ and $Q_G$ signals are connected to the $T_3$ junction point via the OR circuit 81, the $Q_H$, $Q_I$ and $Q_T$ signals are connected to the $T_2$ junction point via the OR circuit 82, and the $Q_K$, $Q_L$, $Q_M$, $Q_N$, $Q_O$ and $Q_P$ signals are connected to the $T_1$ junction point via the OR circuit 83. Therefore, when the output of the OR circuits 81, 82, 83 are at a high level, the transmission gates 53, 52, 51 are respectively conducting and the output from the flip-flop 70 respectively has 3/16, 2/16, and 1/16 duty cycles.

Figure 11:
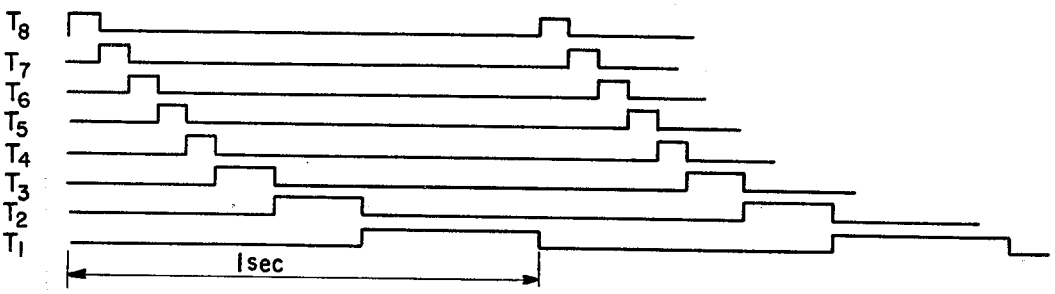
Figure 12:
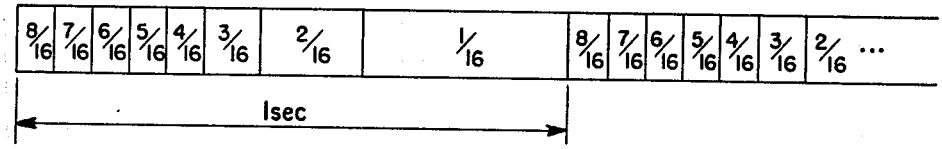
FIG. 12 is a model diagram showing the output signal of the alarm signal compound circuit.

FIG. 11 shows the wave shapes of the signals at the $T_8$ to $T_1$ junction points wherein the $T_8$, $T_7$, $T_6$, $T_5$, $T_4$ points have applied thereto respectively the signals $Q_A$, $Q_B$, $Q_C$, $Q_D$, $Q_E$ and the high level period of each signal is 1/16 second. The high level period of the signal at the $T_3$ point is 2/16 second which is obtained by the $Q_F$, $Q_G$ signals, the high level period of the signal at the $T_2$ point is 3/16 second which is obtained by the $Q_H$, $Q_I$ and $Q_J$ signals and the high level period of the signal at the $T_1$ point is 6/16 second which is obtained by the signals $Q_K$, $Q_L$, $Q_M$, $Q_N$, $Q_O$ and $Q_P$. The duty cycle of the output signal of the flip-flop 70 varies by the above mentioned operation and a model diagram of the duty cycle is shown in FIG. 12. Namely, the duty cycle varies from 8/16 to 1/16 and the repeating period thereof is 1 second. Thus the output signal from the flip-flop 70 the duty cycle of which varies at 4096 Hz is fed to one input of the AND circuit 71 and, the alarm set signal produced from the total coincidence circuit 9 in FIG. 4 is fed to the other input of the AND circuit 71. Accordingly the AND circuit 71 produces or gates the output signal of the flip-flop 70 only at the predetermined alarm time.

Figure 15:
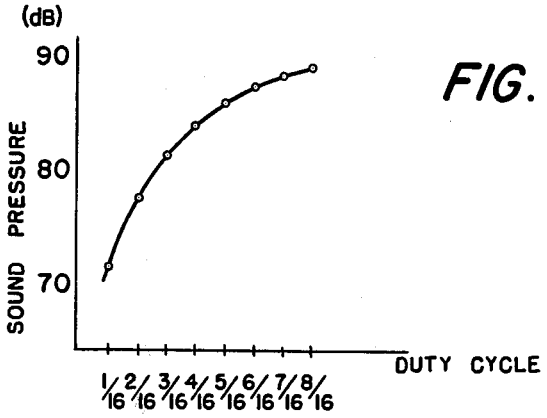
FIG. 15 is a graph showing the relation between the duty cycle and the sound pressure of the electromagnetic speaker of the present invention.
Figure 16:
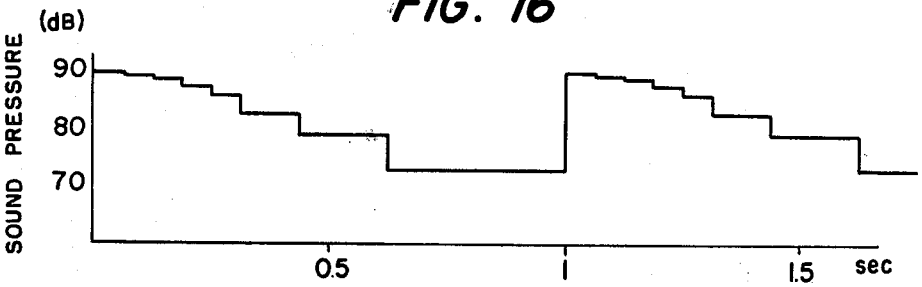
FIG. 16 is an hourly variation diagram of the sound pressure attributable to the circuits of FIG. 6.

The operation of the alarm signal compound circuit 12 has heretofore been described and a description will now be given of the operation of the driving circuit 13 which receives the output signal compounded in the alarm signal compound circuit 12, i.e. the output signal from the AND circuit 71, and the speaker 14. The speaker employed in the present invention is an electromagnetic speaker of 80Ω coil resistance and 4 mH inductance. FIG. 15 shows a set measured results of the sound pressure obtained by the application of a drive signal having the different duty cycles at the frequency of 4096 Hz) to applied the base of transistor 72 in the driving circuit construction shown in FIG. 6. The sound pressure was measured at a distance of 10 centimeter from the sound source when the power source was 1.5 V and the OdB of which was 0.0002 microbar. Namely, in the driving circuit construction shown in FIG. 15, the conducting period of the transistor 72 is different according to the duty cycle, in other words, the conducting period varies according to the high level period of the signal fed to the base of the transistor 72, therefore the sound voltage obtained by variation of the current flow period through the speaker 14 is as shown in FIG. 15. As mentioned above, the signal of varying duty cycle is produced from the AND circuit 71 and has duty cycle pattern as shown in the model diagram of FIG. 12 when the alarm signal is at a high level and the transistor 72 is switched on according to the output signal, and the hourly variation of the sound pressure i.e., the sound pressure variation pattern, produced from the speaker 14 is shown in FIG. 16. Though FIG. 16 shows the stepping variation of the sound pressure, the actual sound is like that of ringing bells and attenuation of the bell ringing sound seems to be smooth. This is because the sense of hearing of human beings cannot sensitively react to the sound voltage variation occurring during so short a period. As illustrated, the variation of the duty cycle of the audible signal effects the variation of sound pressure so that a sound simulating the ring of bells can be obtained. Furthermore, the various sounds can be obtained by variation of construction of the alarm signal compound circuit 12. Accordingly, another embodiment will be illustrated hereafter.

Figure 13:
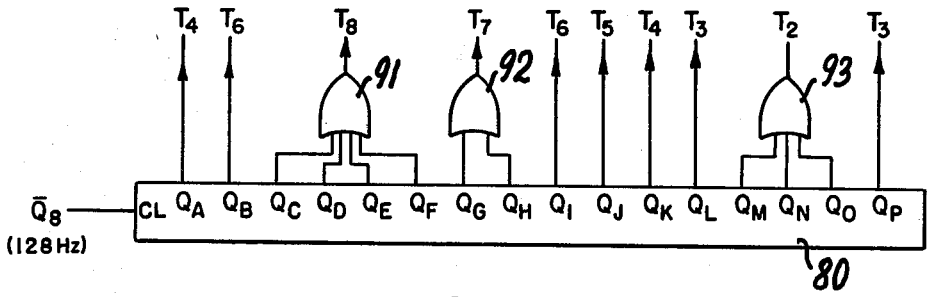
FIG. 13 is a circuit diagram of another embodiment of part of an alarm signal compound circuit of the present invention.

FIG. 13 is a circuit diagram of part of the alarm signal compound circuit 12 and that part of the circuit which is the same as that shown in FIG. 6 is omitted. Numeral 80 is a 16-step ring counter similar to that shown in FIG. 6 and to the clock terminal CL of which there is fed an output signal $\overline{Q}_8$ (128 Hz) from the flip-flop 29 in FIG. 5. The output signal $Q_A$ of the ring counter 80 is fed to the $T_4$ junction point, the output signal $Q_B$ is fed to the $T_6$ junction point, signals $Q_C$, $Q_D$, $Q_E$ and $Q_F$ are fed to an OR circuit 91 whose output is fed to the $T_8$ junction point, and the signals $Q_G$ and $Q_H$ are fed to an OR circuit 92 whose output is connected to the $T_7$ junction point. Furthermore, the output signal $Q_I$ is fed to the $T_6$ point, the signal $Q_J$ is fed to the $T_5$ point, the signal $Q_K$ is fed to the $T_4$ point, the signal $Q_L$ is fed to the $T_3$ point, the signals $Q_M$, $Q_N$, $Q_O$ are fed to an OR circuit 93 whose output is connected to the $T_2$ point and the signal $Q_P$ is connected to the $T_3$ point. The other portions, namely the construction and operation of the alarm electronic timepiece illustrated in conjunction with FIG. 4, the construction and operation of the dividing circuit illustrated in conjunction with FIG. 5, the alarm sound compound circuit and the driving circuit illustrated according to FIG. 6 except the ring counter 80 and the connection between the ring counter 80 and the $T_1$ to $T_8$ junction points are the same as in the former embodiments.

Figure 14:
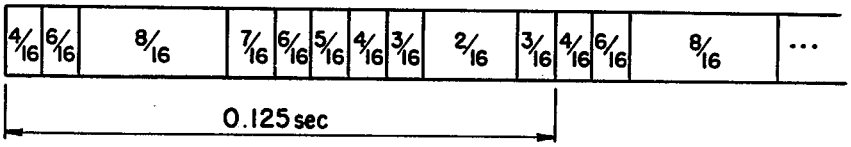
FIG. 14 is a model diagram of the output signal of the alarm signal compound circuit of FIG. 13.
Figure 17:
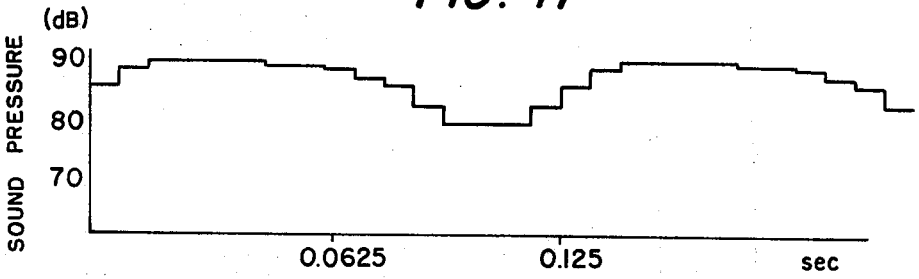
FIG. 17 is an hourly variation diagram of the sound pressure attributable to the circuit of FIG. 13.

The operation of this embodiment will now be described. The output signals $Q_A$ to $Q_P$ from the ring counter 80 are as shown in the timing chart of FIG. 10 when the signal of 128 Hz ($\overline{Q}_8$) is fed to the clock terminal CL and the period of each of the output signals is $\frac{1}{8}$ second and the period of the high level is 1/128 second. Accordingly, the $T_4$ point, $T_6$ point, $T_8$ point and $T_7$ point come to high level respectively by 1/128 second, 1/128 second, 4/128 second and 2/128 second in sequence, and the $T_6$, $T_5$, $T_4$, $T_3$ points come to high level by 1/128 second, the $T_2$ point comes to high level by 2/128 second and the $T_3$ point reaches high level by 3/128 second in succession. As illustrated by the operation of FIG. 6, when the $T_2$, $T_3$, $T_4$, $T_5$, $T_6$, $T_7$ and $T_8$ points are at a high level, the output signal of 4096 Hz frequency of the D-type flip-flop 70 is the same and the signals whose duty cycles are respectively 2/16, 3/16, 4/16, 5/16, 6/16, 7/16, 8/16. The duty cycle pattern of the output signal of the flip-flop 70 is as shown in the model diagram of FIG. 14. The sound pressure variation pattern obtained when the speaker 14 is driven by the driving circuit of FIG. 6 by the output signal of the flip-flop 70 is as shown in FIG. 17.

Though the variation of the sound pressure of this embodiment is also a stepped variation, the sound variation comes to the ear is smooth. Moreover, since the reiteration period of the sound pressure variation of this embodiment is $\frac{1}{8}$ second and quicker than the former embodiment, the tremolo effect is obtained.

As illustrated by way of the two foregoing embodiments, according to the present invention, a comfortable and impressive alarm sound as compared with the conventional monotonous and uncomfortable alarm sound is realized. While the invention has been described in its preferred embodiments, it is to be understood that the invention is not limited thereto and the other variations of the alarm sound are possible. Namely, by variation of the arrangement of the duty cycle (FIGS. 12 and 14 in the present embodiments), variation of grading of the duty cycle (8 steps from 1/16 to 8/16 in the present embodiments) and variation of a number of the ring counter and frequency of the clock (16 Hz and 128 Hz by 16 steps in the present embodiments), various other alarm sounds can be obtained. Particularly, though the content of the duty cycle varies by 1/16 in the present embodiment, the content of the sound pressure can be established according to the number of steps and the content of the duty cycle is improved. If the highest frequency obtained within a timepiece, i.e. the oscillating frequency of the standard signal oscillating circuit 1 is $f_O$ (32,768 Hz in these embodiments) and the frequency of audible sound signal is $f_A$ (4096 Hz in these embodiments), the duty cycle of the audible signal is varied by $f_A/2.f_O$ (1/16 in these embodiments) at minimum. For instance, if the frequency of the audible signal is 2048 Hz, the duty cycle of the audible signal is varied by 1/32 and a more smooth variation of the sound pressure is possible. While the frequency of the audible signal is fixed at 4096 Hz in the disclosed embodiments, alarm sounds of different tone can be obtained by variation and coupling of plurally selected duty cycles.

The present invention eliminates the insufficiency of the prior art type alarm sound, namely, the monotonous, mechanical and artificial alarm sound caused by intermittence by rectangular waves, by effecting a smooth amplitude variation of the sound pressure. Further, as shown in the present embodiments, it is possible to simulate a natural sound such as a ring of bells or a tremolo effect. Although the above mentioned effects are attributable primarily to the psychological effect of sound which is rather subjective, the following practical effects are also of great significance. Namely, according to the present invention, particular analogue circuits such as D-A transducer, an analogue signal amplifier or the like are not necessary to provide an analogue variation of the sound pressure and the alarm electronic timepiece can be composed of digital circuit elements, whereby the circuit composition is easy. The circuit of the present invention can be easily fabricated in the form of a MOS IC which at present comprise the electronic circuitry for wrist watches.

Further, according to the present invention, the alarm sound of various tones can be composed. For instance, in an alarm electronic timepiece having a plurality of channels, an original alarm sound can be sounded in each of the channels and, an original time signal sound which is suitable for the time signal can be sounded. Especially, by the miniaturization of the electronic circuit portion, an electronic timepiece can be provided with various additional functions and the timepiece not only provided with the time display function but also a portable information function can be obtained. In this case, the present invention is provided with the auditory means, whereby the effect and amount of communication is increased in comparison with the conventional visual display means.

We claim:

1. An alarm electronic timepiece comprising in combination: a time circuit including a time standard signal oscillator for generating a time signal; a time display portion responsive to the time signal for displaying time; an alarm device for generating an alarm sound; an alarm driving circuit for driving said alarm device; and an alarm signal compound circuit comprising first means for developing a plurality of signals having different duty cycles and having a frequency in the audible frequency range, and second means for serially arranging said signals to form an alarm signal composed of the serially arranged signals of different duty cycles and for applying the alarm signal to said alarm driving circuit.

2. An alarm electronic timepiece as claimed in claim 1, wherein the oscillating frequency of said time standard oscillator is $f_O$ and the frequency of said alarm signal is $f_A$ and the minimum value of a change of duty cycle is $f_A/2f_O$.

3. An alarm electronic timepiece as claimed in claim 1, wherein said alarm signal comprises said serially arranged signals being arranged according to successively descreasing duty cycles to thereby obtain an alarm sound of gradually decreasing volume.

4. An alarm electronic timepiece as claimed in claim 3, wherein said alarm signal composed of said serially arranged signals is constantly repeated in a certain period of time.

5. In an alarm electronic timepiece having alarm-sounding means responsive to an electrical alarm signal applied thereto for sounding an audible alarm sound at a predetermined alarm time: means for generating an electrical alarm signal having a frequency within the audible frequency range and having a predetermined pattern of different duty cycles corresponding to a predetermined sound pressure variation pattern and for applying the electrical alarm signal to said alarm-sounding means to produce an audible alarm sound corresponding to said predetermined sound pressure variation pattern.

6. In an alarm electronic timepiece according to claim 5; wherein said means for generating comprises means for generating a plurality of signals having a frequency within the audible frequency range and having different duty signals, and means for serially arranging said plurality of signals according to said predetermined pattern to thereby form said electrical alarm signal having a frequency within the audible frequency range and having said predetermined pattern of different duty cycles corresponding to said predetermined sound pressure variation pattern.

7. In an alarm electronic timepiece according to claim 6; wherein said means for generating includes means for generating and applying said electrical alarm signal in a constantly repeating sequence during a predetermined period of time.

8. In an alarm electronic timepiece according to claims 5, 6 or 7; wherein said predetermined pattern of different duty cycles is selected to produce an audible alarm sound corresponding to a predetermined sound pressure variation pattern simulating a ringing bell sound.

9. In an alarm electronic timepiece according to claims 5, 6 or 7; wherein said predetermined pattern of different duty cycles is selected to produce an audible alarm sound corresponding to a predetermined sound pressure variation pattern simulating a tremolo sound.

10. In an alarm electronic timepiece according to claims 5, 6 or 7; further comprising an oscillating circuit for generating a high frequency time standard signal having a frequency $f_O$; and wherein said means for generating comprises means for generating said electrical alarm signal at a frequency $f_A$ related to said predetermined pattern of different duty cycles such that the minimum value of change of duty cycle among said different duty cycles is $f_A/2f_O$.

11. In an alarm electronic timepiece according to claims 5, 6 or 7; wherein said means for generating comprises means for generating said electrical alarm signal at a frequency lower than 10 KHz.

12. In an alarm electronic timepiece according to claim 11; wherein the frequency of said electrical alarm signal is 4096 Hz.

* * * * *